US005085276A

United States Patent [19]

Rivas et al.

[11] Patent Number: 5,085,276

[45] Date of Patent: Feb. 4, 1992

[54] PRODUCTION OF OIL FROM LOW PERMEABILITY FORMATIONS BY SEQUENTIAL STEAM FRACTURING

[75] Inventors: Luis F. Rivas, Bakersfield, Calif.; John Reis, Austin, Tex.; Mridul Kumar, Placentia, Calif.

[73] Assignee: Chevron Research and Technology Company, San Francisco, Calif.

[21] Appl. No.: 574,625

[22] Filed: Aug. 29, 1990

[51] Int. Cl.[5] ..... F21B 43/24

[52] U.S. Cl. ..... 166/303; 166/308

[58] Field of Search ..... 166/303, 308, 305.1, 166/263, 281

[56] References Cited

U.S. PATENT DOCUMENTS

| | | | |
|---|---|---|---|
| 2,769,497 | 11/1956 | Reistle, Jr. | 166/308 |
| 3,028,914 | 4/1962 | Flickinger | 166/313 |
| 3,330,353 | 7/1967 | Flohr | 166/303 |
| 3,455,391 | 7/1969 | Matthews et al. | 166/303 |
| 3,739,852 | 6/1973 | Woods et al. | 166/308 |
| 3,782,470 | 1/1974 | West et al. | 166/303 |
| 3,835,928 | 9/1974 | Strubhar et al. | 166/308 |
| 3,878,884 | 4/1975 | Raleigh | 166/308 |

*Primary Examiner*—Thuy M. Bui

*Attorney, Agent, or Firm*—Edward J. Keeling; David J. Power; Robert D. Touslee

[57] ABSTRACT

A production method for low permeability formations is disclosed. Short steam cycles followed by production of fluids to the surface from a single wellbore is described. The method may be practiced in sequential manner, thereby accessing multiple intervals of hydrogen containing formation. Reflashing of steam into the wellbore allows production of fluids to the surface without a pump in the wellbore.

12 Claims, 6 Drawing Sheets

PRODUCTION OF OIL FROM LOW PERMEABILITY FORMATIONS BY SEQUENTIAL STEAM FRACTURING

FIELD OF THE INVENTION

The present invention relates to the recovery of crude oil from underground formations. In particular, it relates to a method of producing oil from formations having very low relative permeability.

BACKGROUND OF THE INVENTION

Diatomite formations are unique due to a high oil content and porosity, while having such low permeability that the hydrocarbons have no natural flow path to a production location. In the case of one low permeability formation type, the very low permeability is a characteristic of the morphology of diatomite itself, where skeletal remains of ancient diatoms allow flow only through tiny micropores and openings caused by skeletal decrepitation. The naturally existing flow paths existing in a diatomite reservoir are usually much too small to support flow of fluid, let alone viscous heavy oil. Conventional heavy oil techniques such as conventional cyclic steaming or steam drive, both of which are well known, are not well suited for diatomite because of its extremely low relative permeability. The steam would merely bypass large portions of the diatomite reservoir and other formations. In such a low permeability reservoir, fluid can be injected successfully only after first fracturing the formation by injecting fluid at pressures exceeding the fracture pressure. A significant improvement in diatomite oil recovery technology would require a means to displace oil from the interior of the diatoms themselves. In addition, an improved flow path, or increased permeability, would be required to assist the flow of displaced oil from the reservoir interior to a production position, i.e., a wellbore.

The literature has seen many attempts aimed at recovering oil from diatomite formations. U.S. Pat. No. 4,167,470 teaches one method of recovering oil from diatomite in which a hydrocarbon solvent is contacted with diatomite ore from a mine in a six-stage extraction process. Solvent is recovered in a steam stripping apparatus. There are several problems in utilizing this solvent process in a cost effective operation. One major drawback is that the diatomite ore must be mined, carrying significant environmental and economic drawbacks, and the process is extremely complex and intensive. Furthermore, the process cannot be carried out in a manner utilizing equipment typical to oil field operations.

U.S. Pat. No. 4,828,031, assigned to the assignee to the present invention, is an improved method of recovering oil from diatomite formations. A solvent is injected into the diatomite and is followed with a surface active aqueous solution. The solution contains a diatomite/oil water wettability improving agent and surface tension lowering agent. The method may be enhanced by the injection of steam into the diatomite formation. No teaching is made, however, of the methods described herein for creating and enhancing a fracture flow path with controlled fracturing technique. U.S. Pat. No. 4,828,031 is useful, however, in the present case for a description of the general problems associated with production of oil from diatomite formations.

U S. Pat. No. 4,645,005 teaches a production technique for heavy oils, in unconsolidated reservoirs as opposed to diatomite. The formation may be fracture stimulated with steam prior to completion by conventional gravel pack. However, U.S. Pat. No. 4,645,005 fails to teach how fracture initiation and growth is controlled, and makes no teaching of dealing with the special considerations present with a very low permeability reservoir.

Methods of fracturing formations using bridge plugs and sandback techniques in combination with a pumped hydraulic fluid have been described. One such reference is in Hydraulic Fracturing, SPE Monograph Series Vol 2, by G. C. Howard et al., at pages 99–100.

It is apparent that an improved method of producing oil from low relative permeability formations such as diatomaceous formations is much desired.

DETAILED DESCRIPTION OF DRAWINGS

SUMMARY OF THE INVENTION

Figure 1:
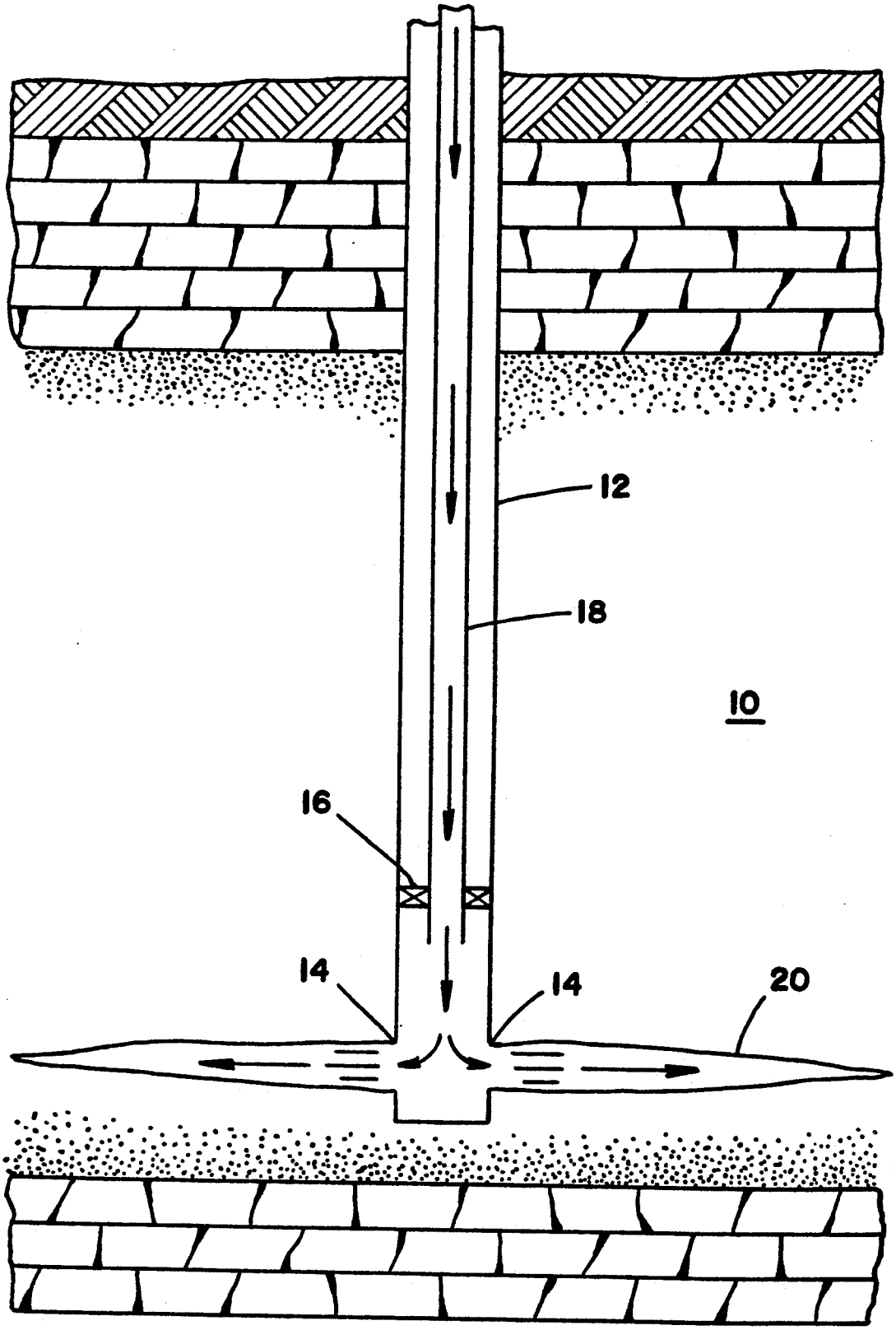
FIG. 1 is a cross-sectional view of a well bore traversing a low permeability formation having a set of perforations at its lower interval adjacent to a first fracture set created during a steaming cycle.

We have devised a greatly improved method of producing oil from low permeability formations. The method generally involves the drilling of a wellbore which traverses the low permeability formation. First, a lower interval within the low permeability formation is selected and perforated. Tubing is run into the wellbore, and a thermal packer is set at the upper boundary of the low permeability formation to be produced. Steam is injected into the wellbore through the tubing at sufficient pressure and flow rate to cause the low permeability formation at the first selected lower interval to accept fluid in the case of naturally fractured low permeability formations, or to fracture in other formations such as diatomite. The steam injection is continued until a predetermined quantity of steam has been injected. We have had good results ceasing injection following between 2,000 and 10,000 and preferably between 3,000 and 5,000 barrels of wet injected steam. Following a short "soak" period, the well is allowed to produce back from the first set of perforations. Short steam cycles alternating with production are repeated for the first interval in the wellbore. Next, sand or sand in combination with other material impervious to steam such as cement, or a mechanical isolation device, is placed into the wellbore sufficient to prevent steam from entering the formation through the first set of perforations. A second interval in the low permeability formation is then selected and perforated. Steam is once again flowed from the surface down the wellbore and may enter the formation only through the new second set of perforations due to the impervious sand or other blocking means in the wellbore. After a predetermined amount of steam is flowed into the formation to cause controlled fracturing from the second set of perforations, the steam flow is ceased and after another short soak period of about five days, the well is allowed to produce from the second interval. Again, alternating steam and production cycles of short duration without a significant period in between due to well pump pulling is accomplished. The sequence of perforating, steam fracturing, and cycle steaming and producing the new fractures, followed by sanding back or otherwise isolating, and repeating at an upper interval is repeated until a desired amount of the low permeability formation has been fractured and completed by the controlled technique of the present invention.

When the final set of perforations has been completed, steamed and produced for several cycles, the sand, isolating device or other steam impervious material is circulated out, or drilled through, so as to open all the perforations and place the fractured intervals in fluid communication with the wellbore. Steam from a surface steam generator may then be flowed down the tubing and into the entire set of previously isolated perforations, and after a short cycle of steam followed by a soak period, the well is returned to the production mode. Alternatively, any single or set of fractured intervals may be isolated and selectively re-steamed.

Among other factors, we have found that "leak-off" of injected steam from the fracture to the surrounding formation is greatly reduced over that of conventional cyclic steaming in an unconsolidated reservoir where permeability is much greater in the formations of interest here. Surprisingly, we have found that heating of the formation water and its "flashing" from a liquid to a gas phase upon reducing wellbore pressures when returning to the production mode produces significantly increased quantities of oil from the formation to the wellbore. Indeed, we have further found the "flashing" effect to continue within the wellbore, as pressure therein reduces, thus aiding the flow of fluids to the surface for recovery from the wellbore.

By the method of the present invention, a single wellbore completed in the low permeability formation by the techniques described herein may be used for both the injection and production well. Further, it is typical that sufficient reservoir pressure exists following the low permeability formation being heated and injected with steam that a wellbore pump is not required to lift production fluids to the surface. Short steam periods followed by a flowing production period is continued to economically recover oil from the low permeability formation.

DETAILED DESCRIPTION OF THE INVENTION

Referring to FIG. 1, the first step in producing oil from a low permeability formation 10 is to drill a wellbore 12 which traverses the formation. Formation 10 is a diatomite formation having no significant natural fractures. Other low permeability formations having natural fracture networks would be applicable to the present invention. A first set of perforations 14 are formed at a lower interval of interest. The perforation may be accomplished using well known methods and tools such as Schlumberger's UltraJet Gun or the like. The length of the perforated interval is dependent upon the reservoir porosity, permeability and oil saturation. Primarily, core sample analysis or logs may be used to determine the intervals to be benefited most from the selective sequential fracturing methods of the present invention. The principal consideration is to perforate and fracture only that portion of the low permeability formation which can be effectively steam fractured at one time. To attempt more at one time may result in by-passed intervals and poor oil recovery.

We have found that perforating at 120° phasing at four shots per foot achieves good results. After a first set of perforations has been made, thermal packer 16 is made up on a single string of insulated tubing 18. Due to the high temperature of flowing high pressure steam, we have found it quite advantageous to use insulated tubing such as Kawasaki Thermocase or the like. With thermal conductivity minimized between the fluid in the insulated tubing and the wellbore casing, we have found up-hole casing temperatures to drop from around 500° F. to less than 250° F. versus operating with a conventional uninsulated tubing string. Alternatively, or in combination with the use of insulated tubing, prestressing of wellbore casing to minimize harmful effects resulting from thermal expansion of the casing may be done. Thermal packer 16 into which tubing 18 is connected in the wellbore are known to those skilled in heavy oil production. The packer is a retrievable type which allows removal during sequential perforating steps of the present invention, and resetting for steaming and production. With tubing and packer run-in and set, steam from a surface steam generator is flowed down the tubing at sufficient pressure to create fracture 20 in the low permeability formation adjacent the first set of perforations 14.

Figure 2:
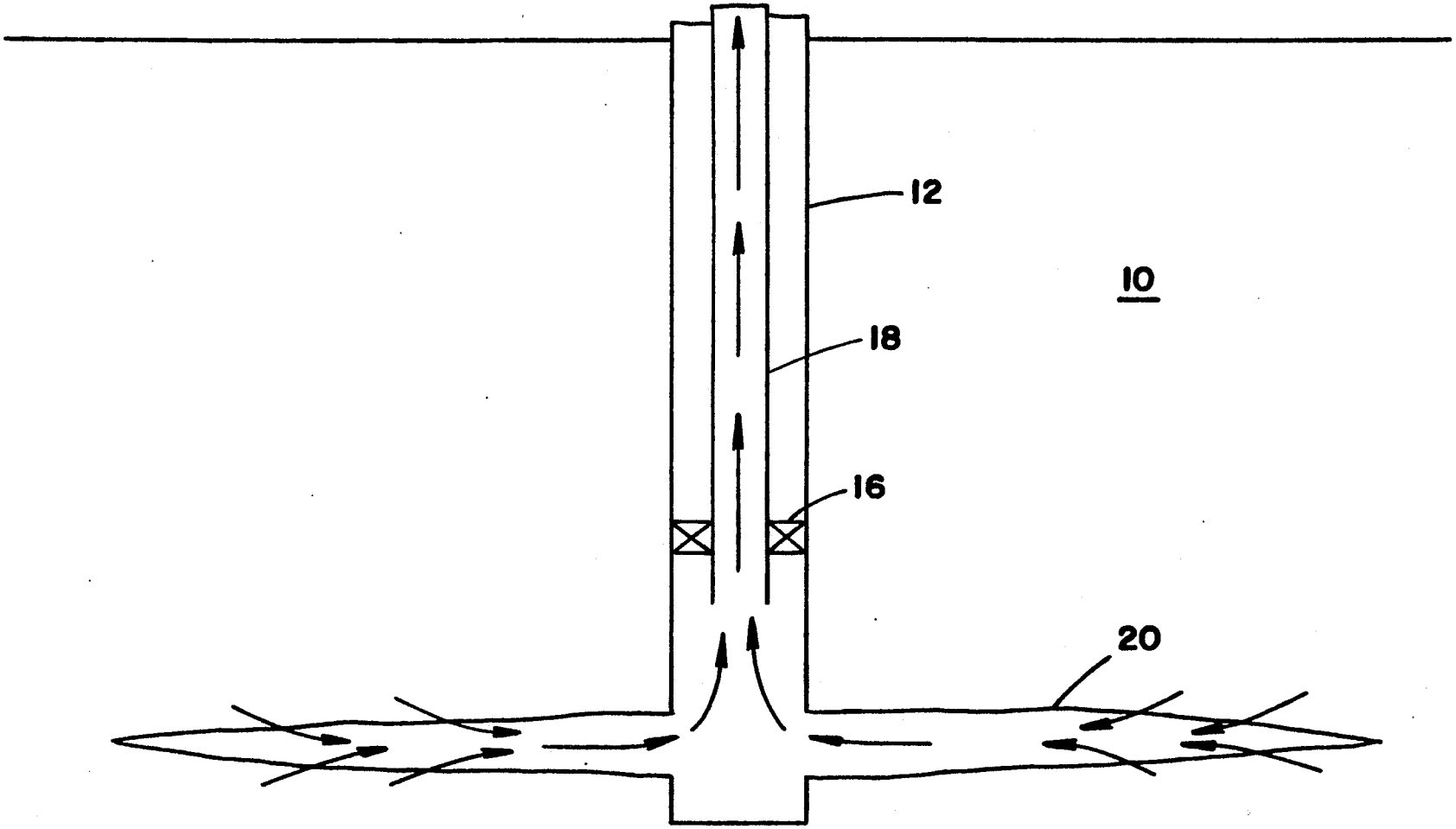
FIG. 2 is a cross-sectional view of the wellbore during the first production cycle, indicating the reflashing mechanism as a means of driving hydrocarbons from the formation.

The steam is wet, that is, it contains a water phase, having a typical quality at the surface in the range of between 50% to 80%. Among other factors, we have achieved surprisingly good results from using relatively short steam cycles compared with well-known conventional cyclic steam operations which utilize much larger volumes of steam. Following a first steam cycle on the first set of perforations of between 2,000 and 10,000, and preferably between 3,000 and 5,000, barrels of water converted to wet steam, steam flow is ceased and the tubing is placed in fluid communication with oil production facilities such as separators, flow meters, tanks and the like. Hydrocarbons and steam, reflashing from the form of water from the formation, flow back through the first set of perforations 14 as depicted by FIG. 2. We have found the combined effects of increased permeability due to induced fractures and reduced oil viscosity due to heat transfer from injecting steam to have good results on production of oil from low permeability formations.

An important advantage in the practice of the present invention relative to prior art techniques is the ability to flow produced fluids from the formation through the packer 16 and tubing 18 to surface facilities without the aid of a mechanical pumping unit in the wellbore. By completing a wellbore in accordance with the techniques described herein, sufficient reservoir pressure is present, in combination with reduced oil viscosity due to elevated temperature, and the reflashing of steam into and within the wellbore, to support fluid flow without a conventional downhole pump. It will be recognized by those skilled in the art of oil production by thermal EOR methods that such an advantage results in significant savings and equipment capital costs, operating expense and maintenance.

A first production cycle for the first perforated interval is continued until reservoir pressure approaches the hydrostatic head of the produced fluids in the tubing and thus flow approaches a lower limit of zero. We have found this typically occurs in the range of between 30–60 days after the production cycle begins. This terminal point is dependent upon local conditions of oil content in produced fluid, steam availability and operating economics and will therefore vary from well to well. In the second cycle of the first producing interval, the tubing is again placed in fluid communication with the surface steam source, and another steam injection period is begun at the first perforated interval. The amount of steam is again in the range of between 2,000 and 10,000 barrels of water converted to wet steam. We have found the repeated short steam cycles at the same interval leads to most effective use of injected steam within the low permeability formation, and therefore the most advantageous production economics. After the second steam injection step at the first interval, the flow is again reversed to produce reservoir fluids to the surface through the tubing string. One skilled in the art will readily recognize the methods of the present invention do not require the tubing and packer be removed for steam injection. Because this invention allows steam to be flowed down a tubing string, and for subsequent flowing of produced fluids through the same tubing string immediately following, the economically negative requirement of having to "pull the well"; remove sucker rods and pump prior to steam, and return the same prior to production, and incur the associated lost production time therewith are avoided. The amount of repetition of the steaming and production step at a given interval is dependent upon local conditions. We have found a preferred number of cycles is between 2 and 5 for one diatomite reservoir.

Figure 3:
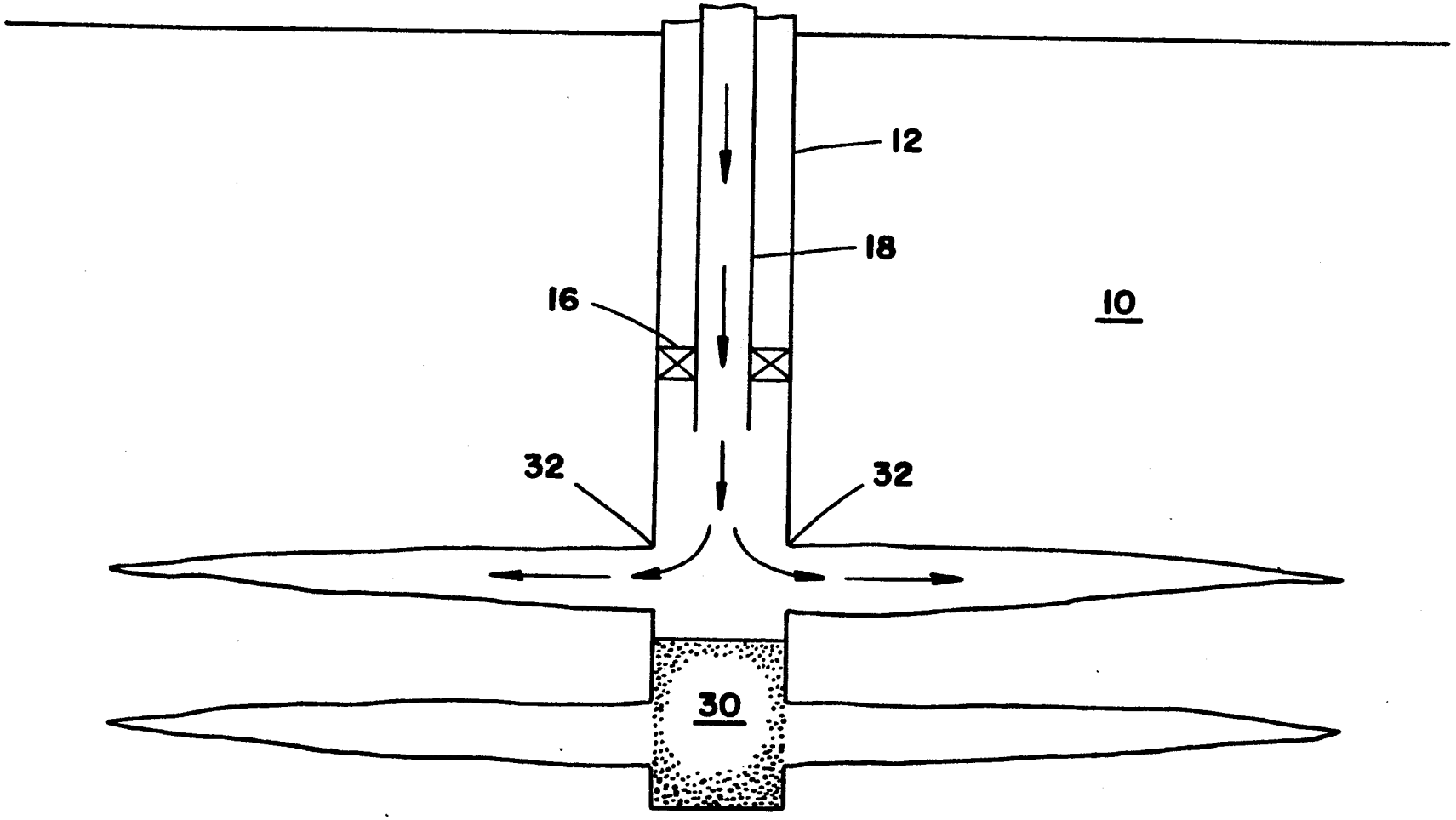
FIG. 3 is a cross-sectional view of the wellbore with the first-lower interval isolated and a second interval created during a steaming cycle.

Referring now to FIG. 3, a second interval within the low permeability formation is selected for fracturing, based on open hole logs, and wellbore cores. We have found it particularly desirable to isolate the interval to now be perforated and fractured by placing within the wellbore a material 30 or other isolation device such as a bridge plug, which is substantially impervious to steam to a level just below the second interval. In this manner, we have had good results using construction grade sand and a 5 to 10 foot cement cap. Perforations 32 are formed at the second selected interval using the casing perforation methods described in the perforating of the first interval above, and using conventional tools well known in the art. With the casing now perforated at the second formation interval, packer 16 and tubing 18 are reset in the wellbore. Initially at the second interval, high pressure steam from a surface steam source is flowed down the insulated tubing string 18, and having access to the lower first interval blocked by the sand 30 or other steam impervious material, the steam is selectively forced out the second interval perforations 32. Steam flow is continued until a predetermined volume of fluid has been displaced. We have had good results when this volume is in the range of between 3,000–5,000 barrels of wet steam, at a surface steam quality of between about 70% and 80%. Pressure recording devices placed in fluid communication with the flowing steam at the wellbottom are useful in determining the extent of fracturing taking place at the isolated formation interval being fractured. Similar to the method employed at the lower first interval, and as depicted by FIG. 2, when steam flow at the second interval is discontinued, production of formation fluids into the wellbore through the second interval perforations is accomplished. Production of fluids into the wellbore and flowing to the surface is maintained without the aid of a mechanical pumping unit, and is continued until a predetermined lower limit of flowing production is observed. The wellbore tubing is placed in fluid communication with a surface steam source again, and a short steam injection cycle is initiated while the second interval perforations are isolated from other perforated intervals, by means of the above described sand plug or isolation device. We have had good results when this second steam cycle is in the range of between 3,000 and 5,000 barrels of wet steam.

Following the second steam injection period at the second perforated interval, the formation is allowed to produce fluids into the wellbore for recovery to the surface through the single string of tubing. As with the lower first perforated interval, the number of steaming periods followed by production may vary due to local conditions. We have had good results using two to five such sequences, while the second interval is isolated from the first by the sand plug.

The steps of locating a formation interval having potential to benefit from selective fracturing techniques may be repeated any number of times until the entire formation of interest has been accessed. While not limiting the scope of our invention, we have found in one producing field that selectively isolating and fracturing from two to three intervals, where each interval is between 50–100 feet, in a single wellbore produces good results.

Following the steam "working" of the top most fractures in the wellbore with alternating production of formation fluids, the entire wellbore is cleaned of steam impervious material by circulating the material to the surface and out of the wellbore, where sand was used as the blocking means.

Figure 4:
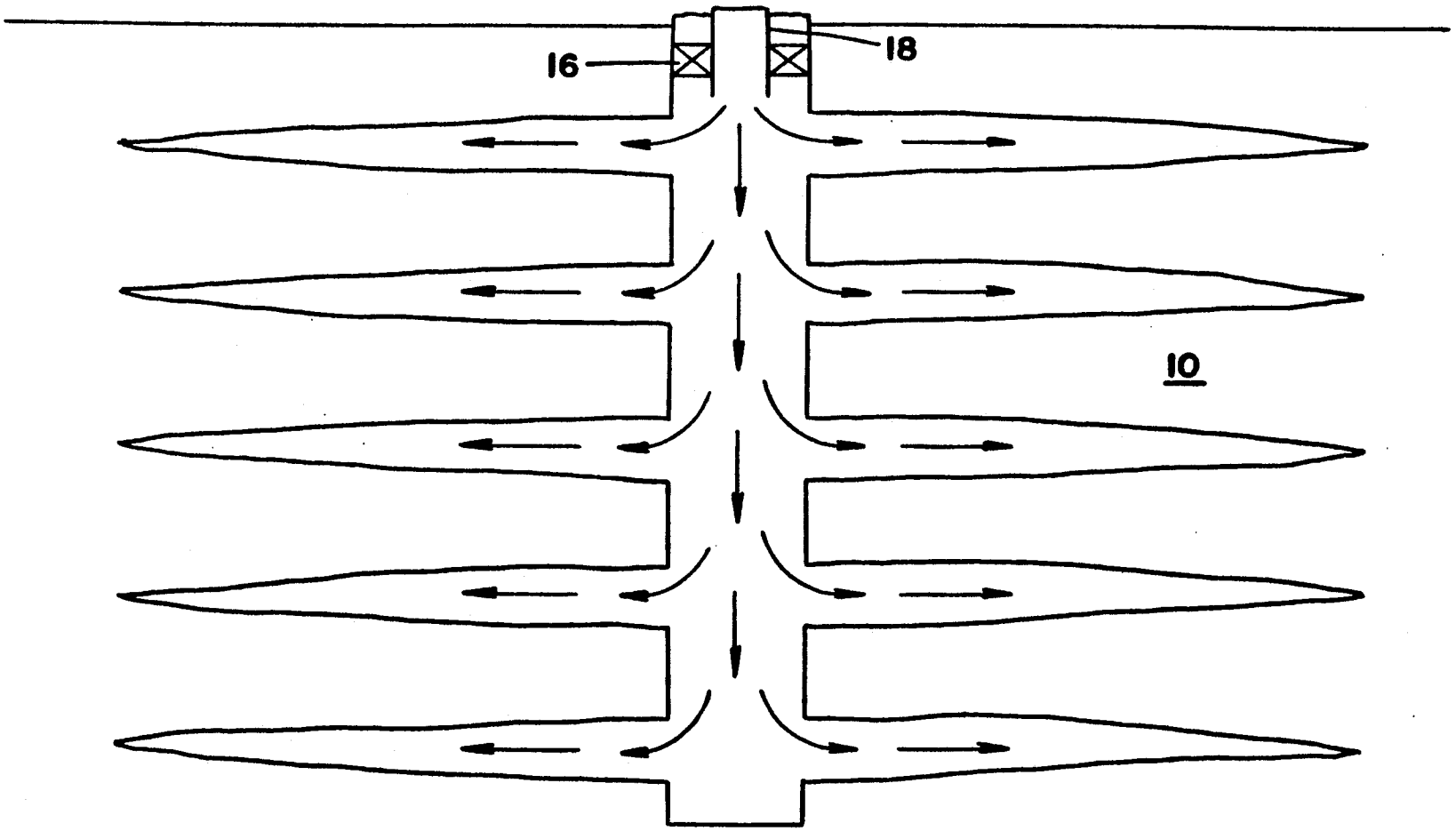
FIG. 4 is a cross-sectional view of the wellbore having a packer set above the last and highest completed interval, with steam flowing simultaneously in all fractured intervals.
Figure 5:
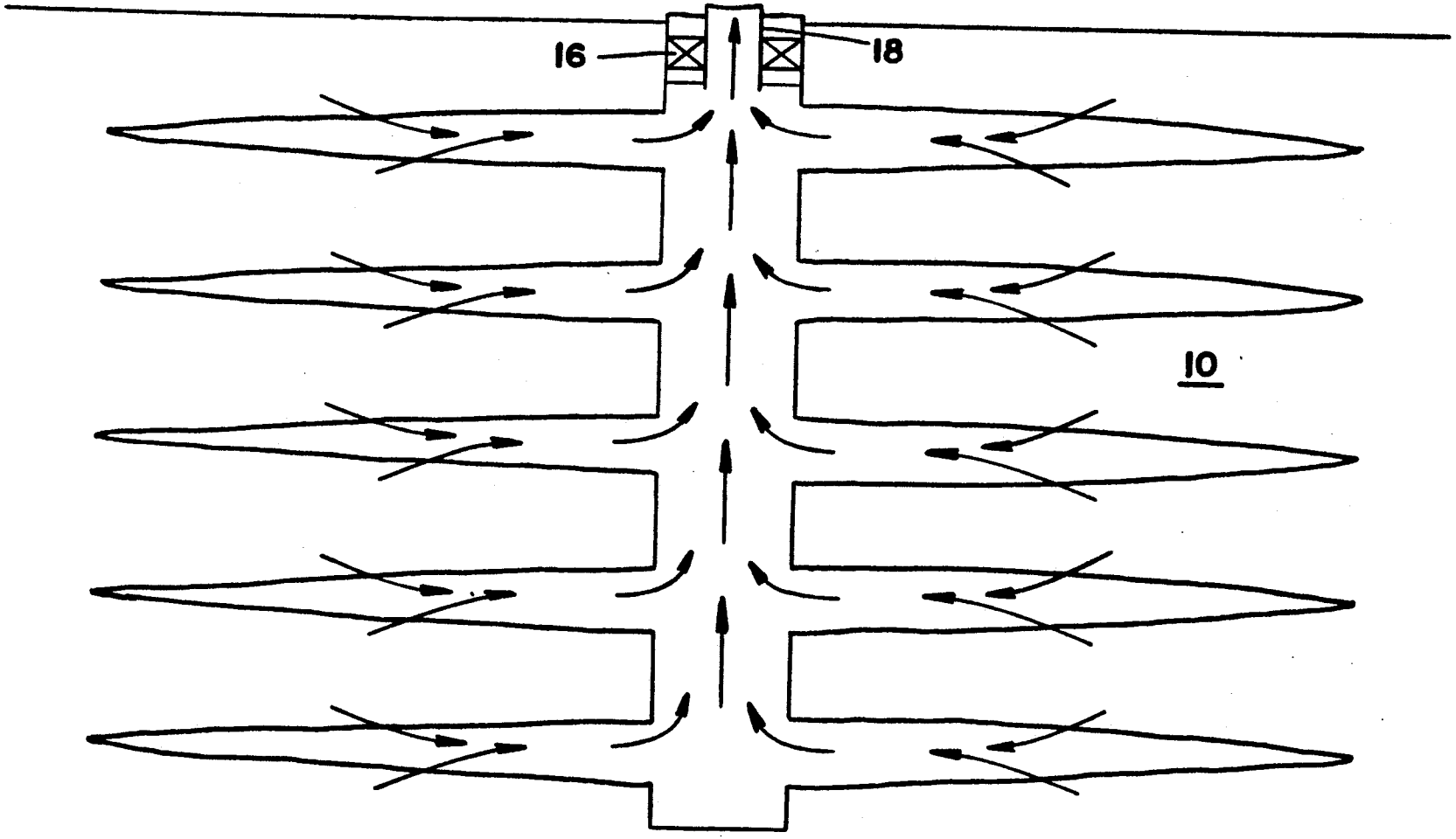
FIG. 5 is a cross-sectional view of the wellbore depicted in FIG. 4 during a production cycle, indicating the reflashing mechanism as a means of driving hydrocarbons from the formation in all said intervals.

Referring now to FIG. 4, a key aspect of the present invention may now be exploited to produce formation fluids for multiple fractured intervals simultaneously. Because the fractures formed through perforations at each selected interval were first isolated and "worked", or "broken down" to increase steam injectivity, access to more of the hydrocarbon containing formation is accomplished because the difference in steam injectivity between intervals is significantly minimized. Therefore, when packer 16 is reset above the last and highest completed interval, steam is flowed simultaneously into all completed intervals. In this manner, a more even distribution of heat is effected into the hydrocarbon containing formation. As depicted by FIG. 4, steam is injected down the single string of tubing 18 and enters each of the fractures to conduct heat in the area of previously fractured intervals. Following a short steam cycle which we have defined as being between 2,000 and 10,000, and preferably between 2,000 and 5,000 barrels of steam per fractured interval, the single string of tubing is placed in fluid communication with surface production facilities and allowed to flow fluids produced from the fractures into the wellbore and up the single string of tubing to the surface for recovery, as depicted in FIG. 5.

In the practice of the present invention, it is not necessary that the wellbore which traverses the low permeability hydrocarbon containing reservoir be vertical. Indeed it is well known by those skilled in the art of hydraulic well fracturing that for deeper formations, existing in-situ stresses result in fractures orienting in a vertical fashion. We have seen a distinct advantage to employing the selective fracturing techniques of the present invention in a formation where induced fractures will orient in a vertical direction, in initiating the fractures from an inclined or horizontal wellbore. Also, one skilled in the art will appreciate that gravity segregation of injected wet steam will be less for a horizontal well than in a vertical wellbore, thereby improving steam distribution between intervals.

Figure 6:
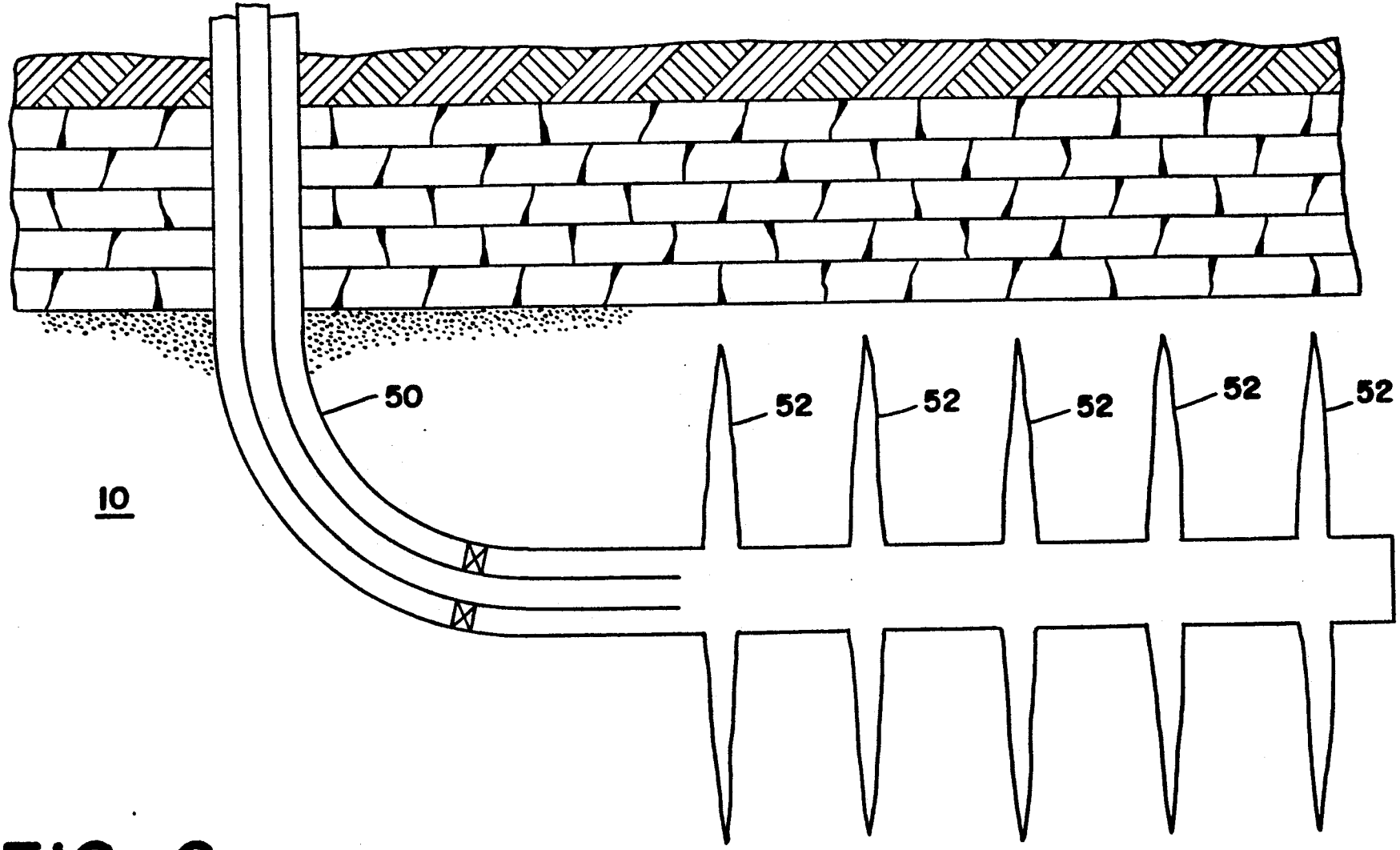
FIG. 6 is a cross-sectional view of a horizontal wellbore traversing a low permeability formation and having selectively perforated zones containing vertical fractures pursuant to the present invention.

As depicted in FIG. 6, a horizontal wellbore 50 which traverses a hydrocarbon containing formation may be selectively perforated and fractured to form vertical fractures 52 using the methods of the present invention. In a horizontal or inclined well, a greater number of fractures in a given formation interval are possible and therefore a greater extent of formation volume may be accessed. Due to greater fracture lengths resulting from an induced fracture which does not re-orient mid-length, an improved result may be had in deeper formations using inclined or horizontal wellbores. The basis for fracture re-orientation is described in application Ser. No. 394,610, assigned to the assignee of the present invention, and is incorporated by reference herein.

EXAMPLE

A test was conducted to characterize steam flow in the formation and to understand the recovery mechanisms better. Arrays of thermocouples were installed in two observation wells and continuously monitored during 10 steam injection and oil production cycles at one well. Injection and production rates, wellhead temperatures and pressures, and downhole pressures were also monitored.

Analysis of results from the first two steam cycles, injection production data from nearby wells, and a numerical simulation of the first two cycles indicated that a significant portion of the injected steam was escaping outside the oil bearing formation to an unconformity, during the conventional large [10,000+ barrels, cold water equivalent (CWE)] steam cycles.

To minimize the amount of steam lost outside the formation, and thereby improve performance, we conducted more frequent, small volume (~3,000 barrels, CWE) steam cycles. We believed that small injection volumes would result in smaller steam volume lost outside the formation and would result in better steam utilization. This is true for diatomites because fluid leakoff from the fracture to matrix is small; consequently, large injection volumes do not result in a proportional increase in steam flow into the matrix.

This test compared the result of eight small steam cycles and evaluated the effectiveness of small cycles by comparing their performance with the first two, conventional, large cycles.

The test was conducted at a well completed in the diatomaceous Shallow Antelope Shale (Opal A) formation. The well is located near the crest of a doubly plunging anticline. At the test location, there are no sand beds, although sandy diatomite and interbedded diatomite and sandy diatomite are present on the southern flank of the anticline.

The first two cycles were performed in a conventional manner, with steam injection of 10,000 barrels, cold water equivalent (CWE) or more. The well was flowing during the production period for all cycles, except for the second cycle, which was pumped after the well stopped flowing. The steam oil ratio (SOR) for the large cycles was 2.8 or greater.

In addition, the produced to injected fluid volume was significantly less than one for the conventional cycles, indicating that a large fraction of the injected fluid was lost outside the formation and was not recovered. This was further confirmed by the temperature profiles in the observation wells (given in the previous section), which showed that steam migrated to the unconformity for the large cycles. Furthermore, a simulation study conducted to match the performance of the first two cycles also showed that a good history match could not be obtained unless a fraction of the injected steam was allowed to migrate outside the formation.

Table I summarizes the injection production data for all ten cycles at the test well. Injection and production data for the fifth through the tenth cycles are combined and averaged because they were similar and deviated less than 10% from the mean values. The third and fourth cycle results are presented separately to illustrate the effect of injection volumes. In addition, the third cycle had significant injection problems affecting its performance.

Referring to Table I, it should first be noted the second cycle was pumped and the oil production numbers may therefore not be directly compared to the other cycles, which were not produced with a pump. As can be readily seen from the results depicted in Table I, particularly the Steam Oil Ratio which is perhaps the most important variable concerning long-term operation of an economic thermal EOR operation, show that for the shorter injection cycles of the fifth through tenth cycles a very attractive Steam Oil Ratio results from the method of the present invention.

TABLE I

INJECTION/PRODUCTION DATA: EFFECT OF SMALL STEAM CYCLES

| | Cycle Number | | | | |
|---|---|---|---|---|---|
| | 1st | 2nd* | 3rd | 4th | 5th–10th |
| Steam Injected (bbl) | 11,400 | 18,600 | 4,640 | 6,880 | 2,900 |
| Oil Produced (bbl) | 2,025 | 6,700 | 1,430 | 2,420 | 2,110 |
| Steam Oil Ratio | 5.6 | 2.8 | 3.3 | 2.8 | 1.37 |
| Produced Water/ Oil Ratio | 0.37 | 0.57 | 0.56 | 0.43 | 0.58 |
| Produced/Injected Volume | 0.24 | 0.57 | 0.48 | 0.50 | 1.16 |

*Second Cycle Was Pumped; Others Flowing

Additional modification and improvements utilizing the discoveries of the present invention which are obvious to those skilled in the art from the foregoing disclosure and drawings and such modification and improvements are intended to be included within the scope and purview of the invention as defined in the following claims.

What is claimed is:

1. A method of improving the steam-to-oil ratio and vertical coverage of a cyclic steam injection process in an oil bearing subterranean formation having low relative permeability as a result of formation morphology, comprising the steps of:

a. drilling and casing a wellbore which traverses the subterranean formation;

b. perforating the casing to create fluid communication between the formation and the interior of the wellbore;

c. cyclically injecting an amount of wet steam in a short cycling sequence sufficient to heat the formation through controllably induced formation fractures while minimizing leakoff from said fractures outside the formation; and d. cyclically producing formation hydrocarbons upon cessation of a steam injection cycle, by reflashing said steam through the wellbore, said reflashed steam having sufficient pressure to drive said hydrocarbons from the formation to the induced fractures and to the surface without the aid of a pump in the wellbore.

2. The method of claim 1 wherein the amount of steam cyclically injected is between 2,000 and 5,000 Barrels CWE per day.

3. The method of claim 1 wherein the subterranean formation is diatomite.

4. The method of claim 1 wherein the hydrocarbons are oil having an API gravity of 20 degrees or less.

5. A method of improving the steam-to-oil ratio and vertical coverage of a cyclic steam injection process in a subterranean formation having low relative permeability as a result of formation morphology comprising the steps of:

a. drilling and casing a wellbore which tranverses the subterranean formation;

b. perforating the casing at a first production interval in the subterranean formation to form a first set of perforations;

c. cyclically injecting steam from a surface steam generator through the first set of perforations at sufficient pressure to controllably induce a first set of fractures in the formation at the first production interval;

d. cyclically producing formation fluids, upon cessation of a steam injection cycle, from the first production interval of the subterranean formation by reflashing said steam through the first set of fractures and into the wellbore through the first set of perforations;

e. isolating the first production interval within the wellbore with a material impervious to steam at a level just above the first perforation interval;

f. perforating the casing at a second production interval at a level in the wellbore superior to the steam impervious material;

g. repeating steps c and d for the second production interval;

h. identifying all remaining production intervals traversed by the wellbore, and repeating steps f and g for each said interval;

i. removing the steam impervious material from the wellbore to create fluid communication between a wellhead located at the surface and the set of fractures at each production interval;

j. cyclically injecting steam from a surface steam generator into the set of fractures at each production interval simultaneously through the set of perforations at each production interval; and k. cyclically producing hydrocarbons, upon cessation of a steam injection cycle, from the subterranean formation by reflashing said steam through the set of fractures at each production interval simultaneously, said reflashed steam having sufficient pressure to drive said hydrocarbons from the formation to the induced fractures and to the surface without the aid of a pump.

6. The method of claim 5 wherein the number of steaming and production cycles for each production interval is between 2 and 5.

7. The method of claim 5 wherein the injected steam is a wet steam, having a quality of about 50% to about 80%.

8. The method of claim 5 wherein the cyclical steaming steps are short cycles of about 3,000 to 5,000 barrels of steam per cycle.

9. The method of claim 5 wherein the wellbore is deviated from vertical at least 20 degrees.

10. The method of claim 5 wherein the wellbore is substantially horizontal.

11. The method of claim 5 wherein the wellbore is drilled in the predetermined direction of minimum horizontal in-situ stress.

12. The method of claim 5 wherein the perforations are at 120° phasing at four shots per foot.

* * * * *

UNITED STATES PATENT AND TRADEMARK OFFICE

CERTIFICATE OF CORRECTION

PATENT NO. : 5,085,276

DATED : February 4, 1992

INVENTOR(S) : Luis F. Rivas, et al.

It is certified that error appears in the above-identified patent and that said Letters Patent is hereby corrected as shown below:

| | | |
|---|---|---|
| Cover page: lines 5-6 | (abstract) | "of hydrogen" should read --of hydrocarbon-- |

Signed and Sealed this

Fourteenth Day of June, 1994

Bruce Lehman

*Attest:*

BRUCE LEHMAN

*Attesting Officer*

*Commissioner of Patents and Trademarks*